US011110362B2

(12) United States Patent
Hama et al.

(10) Patent No.: US 11,110,362 B2
(45) Date of Patent: Sep. 7, 2021

(54) SPINNING TOP LAUNCHING DEVICE

(71) Applicant: TOMY COMPANY, LTD., Tokyo (JP)

(72) Inventors: Hiroyuki Hama, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 16/660,032

(22) Filed: Oct. 22, 2019

(65) Prior Publication Data

US 2020/0171398 A1 Jun. 4, 2020

(30) Foreign Application Priority Data

Oct. 30, 2018 (JP) ..... JP2018-203869

(51) Int. Cl.
*A63H 1/04* (2006.01)
*A63F 9/16* (2006.01)

(52) U.S. Cl.
CPC *A63H 1/04* (2013.01); *A63F 9/16* (2013.01)

(58) Field of Classification Search
CPC ..... A63H 1/04; A63F 9/16
USPC ..... 446/256
See application file for complete search history.

(56) References Cited

U.S. PATENT DOCUMENTS 2,561,601 A * 7/1951 Szonnell ..... A63H 1/04 446/263
3,430,381 A * 3/1969 Phipps ..... A63H 1/04 446/263
3,595,127 A * 7/1971 Stangl ..... F41A 1/08 89/1.815
4,463,745 A * 8/1984 Acker ..... F41B 3/04 124/6
4,867,728 A * 9/1989 Moomaw ..... A63H 1/02 446/259
6,530,817 B1 * 3/2003 Winslow ..... A63H 1/00 446/256
7,063,082 B2 * 6/2006 Vanek ..... F41A 9/65 124/78
8,715,032 B2 * 5/2014 Horikoshi ..... A63H 1/12 446/256

(Continued)

FOREIGN PATENT DOCUMENTS

JP 3160157 U 6/2010

*Primary Examiner* — John E Simms, Jr.
*Assistant Examiner* — Dolores R Collins
(74) *Attorney, Agent, or Firm* — IP Business Solutions, LLC

(57) ABSTRACT

A first locking mechanism is configured to block rotating the first and second holders by locking an operation component or by locking the first and second holders when the cap is not mounted on one of the first and second holders, and is configured to unlock rotating the first and second holders by being engaged with the cap when the cap is mounted on one of the first and second holders and when the cap is arranged to face upwardly towards a upper side. A second locking mechanism is configured to block rotating the first and second holders by locking the operation component or by locking the first and second holders when the cap is mounted on one of the first and second holders and when the cap is arranged to face downwardly to a lower side opposite to the upper side.

6 Claims, 4 Drawing Sheets

(56) References Cited

U.S. PATENT DOCUMENTS

| | | | | |
|---|---|---|---|---|
| 8,839,706 | B1 * | 9/2014 | Macy | F41B 11/54 124/45 |
| 8,887,641 | B1 * | 11/2014 | Manole | F42B 14/06 102/521 |
| 8,939,136 | B2 * | 1/2015 | Gaus | F41F 7/00 124/4 |
| 9,097,476 | B2 * | 8/2015 | Mead | F41A 9/26 |
| 9,101,845 | B2 * | 8/2015 | Cai | A63H 1/18 |
| 9,737,822 | B2 * | 8/2017 | Kubo | A63H 1/04 |
| 9,849,394 | B1 * | 12/2017 | Shindo | A63H 1/02 |
| 9,968,860 | B2 * | 5/2018 | Shindo | A63H 1/04 |
| 10,029,185 | B2 * | 7/2018 | Cai | A63H 1/06 |
| 10,245,518 | B2 * | 4/2019 | Horikoshi | A63H 1/04 |
| 10,500,511 | B2 * | 12/2019 | Muraki | A63H 1/02 |
| 10,525,365 | B2 * | 1/2020 | Muraki | A63H 1/00 |
| 10,543,431 | B2 * | 1/2020 | Muraki | A63H 1/02 |
| 10,543,432 | B2 * | 1/2020 | Hashiba | A63H 1/04 |
| 10,556,187 | B2 * | 2/2020 | Horikoshi | A63H 1/04 |
| 2008/0257326 | A1 * | 10/2008 | St. George | F41B 3/04 124/6 |
| 2011/0177750 | A1 * | 7/2011 | Ujita | A63H 1/04 446/263 |
| 2013/0056929 | A1 * | 3/2013 | Rehkemper | A63H 17/004 273/129 R |
| 2014/0094087 | A1 * | 4/2014 | Colquhoun | A63H 29/24 446/259 |
| 2015/0017872 | A1 * | 1/2015 | Choi | A63H 1/02 446/259 |
| 2015/0253102 | A1 * | 9/2015 | Macy | F41B 11/721 124/76 |
| 2017/0173477 | A1 * | 6/2017 | Shindo | A63H 1/04 |
| 2018/0243660 | A1 * | 8/2018 | Horikoshi | A63H 1/00 |

* cited by examiner

SPINNING TOP LAUNCHING DEVICE

CROSS-REFERENCE TO THE RELATED APPLICATION

The present application claims priority under 35 U.S.C. 119 to Japanese Patent Application No. 2018-203869 filed on Oct. 30, 2018. The entire content of Japanese Patent Application No. 2018-203869 is incorporated herein by reference.

BACKGROUND

Technological Field

The present invention relates to a spinning top launching device.

Background Technology

Conventionally, it is well known that a spinning top launching device has a structure in which a spinning top toy holder is provided in the upper side and the lower side of a device housing. In the spinning top launching device, a spinning top toy is mounted in any one of the spinning top toy holders. When a rotation driving mechanism is operated by an operation unit, the spinning top toy is rotationally energized and launched. In the spinning top launching device, the rotation direction of the spinning top toy which is launched can be changed depending on which spinning top toy holder the spinning top toy is mounted.

By the way, in this spinning top launching device, the spinning top toy which was launched had to be mounted to any one of the spinning top toy holders. However, when the operation unit was operated, the spinning top toy holder in which the spinning top toy was mounted was not only rotated, but also rotated the spinning top toy holder in which the spinning top toy was not mounted at the same time. Therefore, there was a case in which the spinning top toy holder in which the spinning top toy was not mounted collided with an external obstacle so as to be destroyed.

As such the spinning top launching device, normally, the operation unit was locked, and, for example, it may be considered that only when a cap was mounted to the other one of spinning top toy holders, it was unlocked (see e.g., Patent Document 1).

[Patent Document 1] Japanese Registered Utility Model Publication No. 3160157

SUMMARY

Problems to Be Solved by the Invention

However, there were the following problems in the spinning top launching device described in Patent Document 1.

That is, the spinning top toy was launched downwardly, so that after the spinning top toy was mounted in the spinning top toy holder, normally, the spinning top toy was directed toward the lower side, and the operation unit was operated.

However, in the spinning top launching device described Patent Document 1, after the spinning top toy was mounted to the other one of the spinning top toy holders, even when the spinning top toy was directed toward the upper side, when the operation unit was operated, the spinning top toy was launched. In this case, the spinning top toy was dropped off from the device housing, so that the spinning top toy itself may be destroyed.

An object of the present invention is to provide a spinning top toy which can prevent an erroneous shooting.

Means for Solving the Problems

In view of the above problem, a spinning top launching device for spinning a spinning top on a floor includes a rotation driving mechanism, first and second holders, a cap, a first locking mechanism, and a second locking mechanism.

The rotation driving mechanism includes an operation unit and a rotation shaft. The operation unit includes an operation component. The first and second holders are configured on first and second ends of a rotation shaft respectively. The top toy is arranged to be attached to one of the first and second holders. The cap is to cover one of the first and second holders. The first locking mechanism is configured to block rotating the first and second holders by locking the operation component or by locking the first and second holders when the cap is not mounted on one of the first and second holders, and is configured to unlock rotating the first and second holders by being engaged with the cap when the cap is mounted on one of the first and second holders and when the cap is arranged to face upwardly towards a upper side. The second locking mechanism is configured to block rotating the first and second holders by locking the operation component or by locking the first and second holders when the cap is mounted on one of the first and second holders and when the cap is arranged to face downwardly to a lower side opposite to the upper side.

DETAILED DESCRIPTION OF PREFERRED EMBODIMENTS

Figure 1:
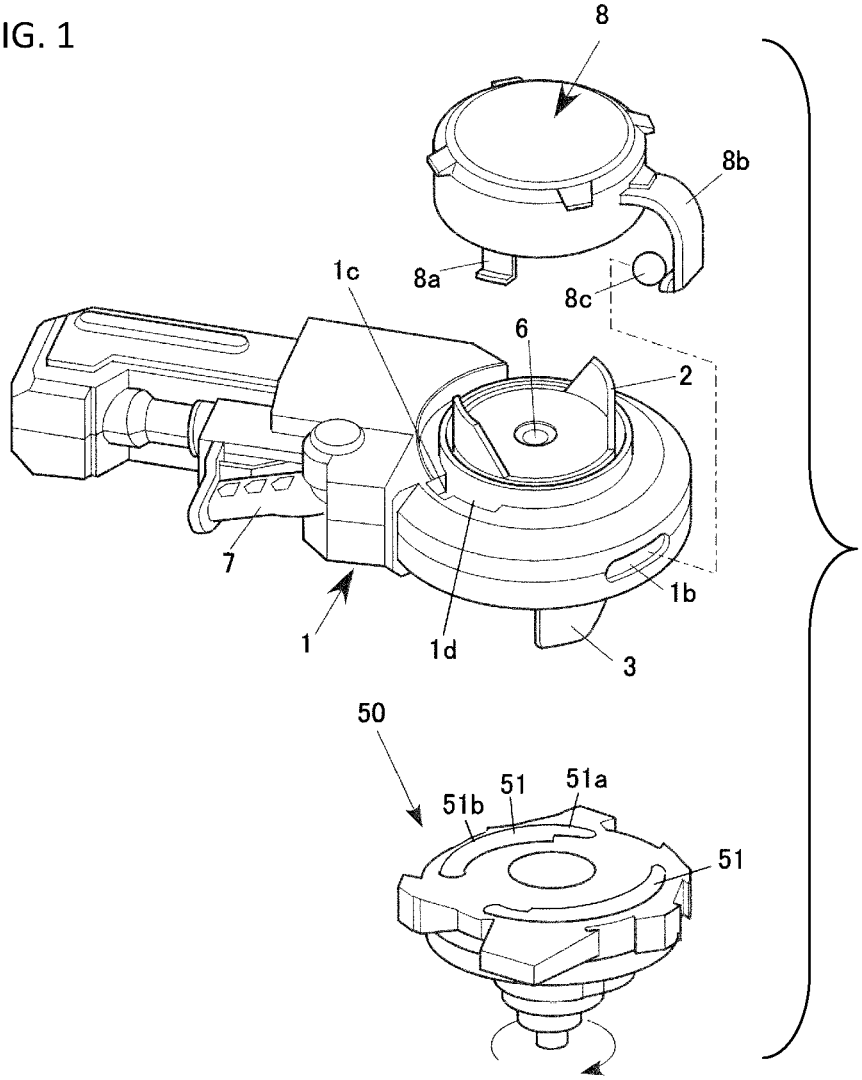
FIG. 1 is a perspective view showing an embodiment of a spinning top launching device according to the present invention.

Hereinafter, a spinning top toy of the present invention will be described based on embodiments shown in the drawings.

Whole Structure

As shown in FIG. 1, a spinning top launching device of the present embodiment is provided with spinning top toy holders 2, 3 which are provided on the surfaces of a device housing 1 in the opposite directions. In each of the spinning top toy holders, a spinning top toy 50 can be mounted. That is, the forks 2*a*, 2*b* of the spinning top toy holders 2, 3 are inserted into the arcuate slits 51 on the upper surface of the spinning top toy 50. The forks 2*a*, 2*b* are engaged with the narrow width pars 51*a* in one end of the arcuate slits.

Figure 2:
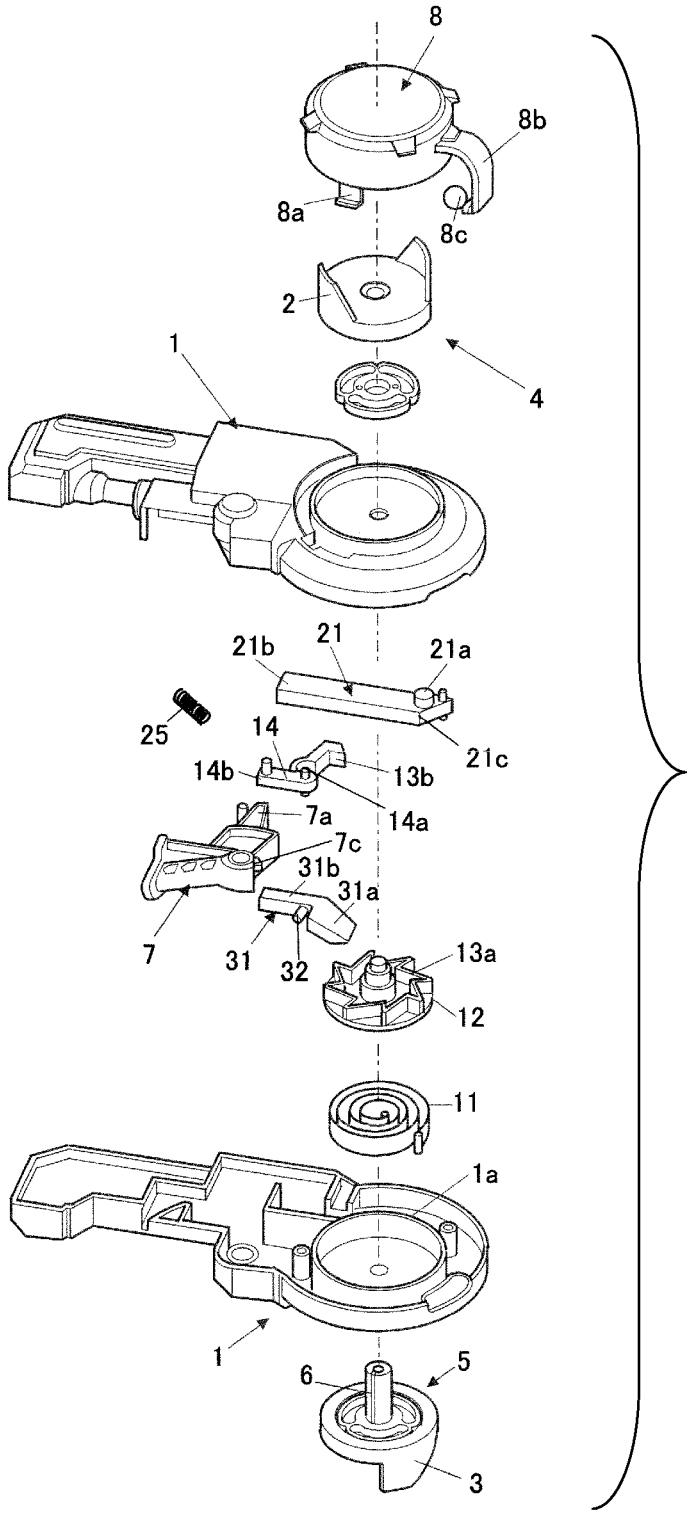
FIG. 2 is an exploded perspective view showing the spinning top launching device.

As shown in FIG. 2, the spinning top toy holders 2, 3 are arranged in the both ends of a rotation shaft 6 through limiters 4, 5. According to the launching device, when the spinning top toy 50 is mounted to any one of the spinning top toy holders 2, 3 and the spinning top toy 50 is directed toward the lower side and an operation lever (operation handle) 7 operates, the rotation driving mechanism 10 is operated, and the spinning top toy 50 can be rotationally launched. That is, when operation lever 7 operates, the rotation driving mechanism 10 is temporarily operated and stopped. In this case, the spinning top toy is still rotated by inertia. However, the forks 2*a*, 2*b* stop and move to the wide width parts 51*b* of one end of the arcuate slits 51, so as to release the engagement of the spinning top toy. Accordingly, the spinning top toy 50 is launched.

A rotation direction of the launched spinning top toy 50 can be changed depending on which one of the spinning top toy holders 2, 3, the spinning top toy 50 is mounted. Further, in the spinning top toy holder in which the spinning top toy 50 is mounted, a cap 8 covers.

Detail Structure

1. Regarding Operation Lever 7

The operation lever 7 triggers the operation of the rotation driving mechanism 10 and it is configured to be operated by a finger.

The operation lever 7 is installed in the device housing 1 through a shaft 7*b*, and is rotatable in a plane orthogonal to the rotation shaft 6. By a spring 25 (see FIG. 2) provided between the lever 14, which will be described later, and a fixed part of the device housing 1, the operation lever 7 is energized toward an initial position by pressing in touch with the other end 14*b* of the lever 14, and the operation of the operation lever 7 is performed against the energizing force of the spring 25.

2. Regarding Rotation Driving Mechanism 10

The rotation driving mechanism 10 applies rotational force to the spinning top toy holders 2, 4 which are installed to the both ends of the rotation shaft 6, and the rotation shaft 6 or the aforementioned operation lever 7 also configures the operation components of the rotation driving mechanism 10.

The rotation driving mechanism 10 is provided with a coil spring 11 which is the power source. The coil spring 11 is stored in a cylindrical spring storage part 1*a* which is formed inside the device housing 1. The coil spring 11 is engaged with one end of the rotation shaft 6, and the other end is engaged with the spring storage part 1*a*. Therefore, when the rotation shaft 6 is rotated in one direction, the coil spring 11 is wound up. Further, when the rotation shaft 6 is rotated in the other direction, the wound coil spring 11 is released.

Further, the rotation driving mechanism 10 is provided with a ratchet mechanism 13. The ratchet mechanism 13 is used to gradually wind up the coil spring 11.

Figure 3:
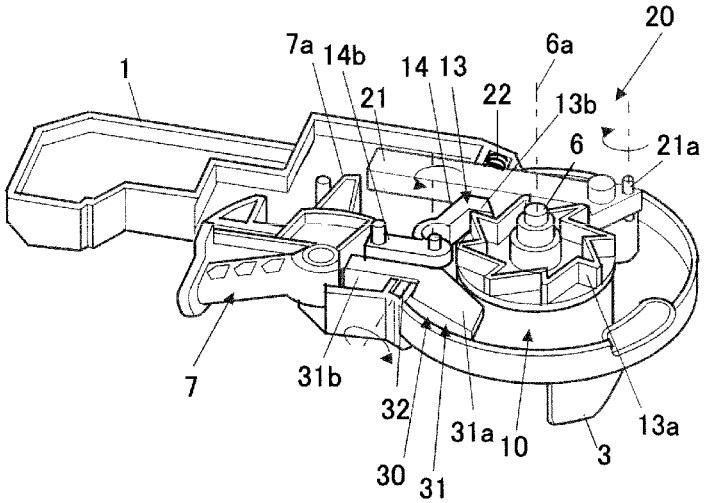
FIG. 3 is a perspective view in a state in which all parts of the spinning top launching device are assembled.

In the rotation shaft 6, a disk 12 is fixedly provided. On the upper surface of the disk 12, a ratchet teeth 13*a* which configures one side of the ratchet mechanism 13 is formed. On the other hand, in the device housing 1, the lever 14 is installed by a shaft 14*a*. In one end of the lever 14, a ratchet hook 13*b* which is configured in the other side of the ratchet mechanism is formed. As shown in FIG. 3, the ratchet hook 13*b* maintains a meshing state in the ratchet teeth 13 by the spring 25.

Further, the other end 14*b* of the lever 14 is provided opposite to the operation lever 7, and when the operation lever 7 operates, the lever 14 is operated by the operation lever 7, so that the meshing between the ratchet hook 13*b* and the ratchet teeth 13*a* is released.

3. Regarding Cap 8

The cap 8 is mounted to one of the spinning top toy holders 2, 3, and it is used to release a lock of the operation lever 7 by the first locking mechanism 20 or the second locking mechanism 30 which will be described later.

The cap 8 is provided with two hooks 8*a* projecting downwardly on the lower end circumferential surface. The hooks 8*a* are provided at a position symmetric with respect to the central axis of the cap 8.

The cap 8 is provided with a flexible belt 8*b*. At the top end of the flexible belt 8*b*, a ball-shaped engagement part 8*c* is formed. The cap 8 is held by inserting the ball-shaped engagement part 8*c* into an arcuate hole 1*b* formed at the side wall of the device housing 1. The cap 8 can be reversed upside down, and can be rotated in a predetermined direction around the rotation shaft 6. With this, the cap 8 can be selectively mounted to the spinning top toy holders 2, 3 positioned in the upper side and the lower side. Further, the hooks 8*a* are inserted and fitted into the rectangular holes 1*c* formed in the device housing 1, and by rotating the cap 8 in a predetermined direction around the rotation shaft 6, it can be engaged with the device housing 1. With such configuration, in the device housing 1, the arcuate slit 1*d* connecting to the rectangular holes 1*c* is formed.

4. Regarding the First Locking Mechanism 20

The first locking mechanism 20 locks the operation lever 7 when the cap 8 is not mounted to any one of the spinning top toy holders 2, 3, and when the cap 8 is mounted to any one of the spinning top toy holders 2, 3, the first locking mechanism 20 is engaged with the cap 8 and unlocks the operation lever 7.

Figure 4:
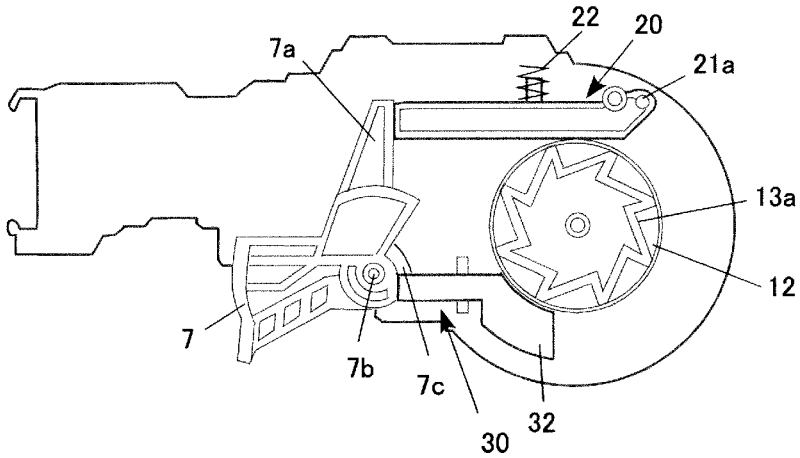
FIG. 4 is a plane view showing the first locking mechanism.

As shown in FIG. 4, the first locking mechanism 20 is provided with a lever 21 which is supported by a shaft 21*a* and rotates in a plane perpendicular to the rotation shaft 6. The lever 21 is urged by the spring 22, and normally, the operation lever 7 is locked by contacting the free end part 21*b* to the top end part 7*a* of the operation lever 7. In the lever 21, when the hook 8*a* of the cap 8 is inserted and fitted into the rectangular hole 1*b* of the device housing 1 and the cap 8 is rotated in the predetermined direction around the rotation shaft 6, the hook 8*a* slides to the corner part 21*c* and is rotated against the urging force of the spring 22, so that the lock is released by separating the free end part 21*b* from the top end part 7*a* of the operation lever 7.

5. Regarding the Second Locking Mechanism 30

The second locking mechanism 30 is engaged with the cap 8 and locks the operation lever 7 when the cap 8 mounted to any one of the spinning top toy holders 2, 3 is positioned in the lower side, and the second locking mechanism 30 releases the lock when the cap 8 is positioned in the upper side.

Figure 5:
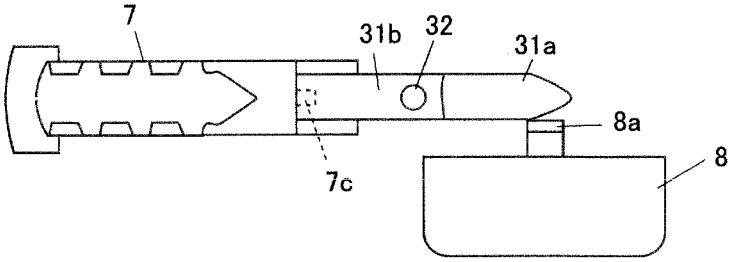
FIGS. 5A and 5B are side surface views showing the second locking mechanism.
Figure 5:
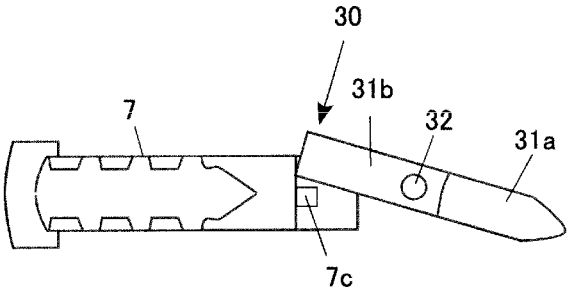

As shown in FIGS. 5(A) and 5(B), the second locking mechanism 30 is provided with a seesaw body 31 which is supported by the shaft 32 and is rotated in a plane parallel to the rotation shaft 6.

In the seesaw body 31, a rotation moment around the shaft of the arm 31*a* with respect to the shaft 32 is set larger than the arm 31*b*. In the seesaw body 31, when the spinning top toy holders 2, 3 are positioned in the upper side and the lower side in the state in which the cap 8 is not mounted to the spinning top toy holders 2, 3, by the gravity, the top end of the arm 31*a* is rotated to move downwardly, and the top end of the arm 31*b* is rotated to move upwardly. In this state, the top end part of the arm 31*b* moves away from the moving area of the projection 7*c* of the operation lever 7 and the lock is released (see FIG. 5(B)). On the other hand, when the spinning top toy holder 2 or 3 in the side to which the cap 8 is mounted is positioned in the lower side, the downward movement of the top end of the arm 31*a* is blocked by the hook 8*a* of the cap 8 in a halfway, and the top end of the arm 31*b* locks the operation lever 7 at the position in the moving area of the projection 7*b* of the operation lever 7 (see FIG. 5(A)). Further, in the seesaw body 31, when the spinning top toy holder 2 or 3 to which the cap 8 is mounted is positioned in the upper side, the downward movement of the top end of the arm 31*a* is not blocked by the hook 8*a* of the cap 8 in a halfway, so that the top end part of the arm 31*b* releases the lock by moving away from the moving area of the projection 7*c* of the operation lever 7.

Effect of the Embodiments

According to the spinning top launching device of the present embodiment, when rotating any one of the spinning top toy holders 2, 3, the coil spring 11 is wound up.

Further, when the spinning top toy 50 is mounted to one of the spinning top toy holders 2, 3, the cap 8 is mounted to the other one. With this, the lever 21 is rotated against the urging force of the spring 22 by the hook 8*a* of the cap 8, and the free end part 21*b* of the lever 21 is moved away from the top end part 7*a* of the operation lever 7, so that the lock of the first locking mechanism 20 is released.

Further, when the spinning top toy holder 2 or 3 in which the spinning top toy 50 is mounted is positioned in the lower side, the seesaw body 31 is rotated by the gravity, and accordingly, the arm 31*a* is moved downwardly and the other end part 1*b* is moved away from the rotation area of the operation lever 7, so that the lock is released. With this, the lock of the second locking mechanism 30 is released.

Therefore, by operating the operation lever 7, the spinning top toy can be launched.

In the state in which the spinning top toy 50 is positioned in the upper side, the rotation of the seesaw body 31 is blocked by the hook 8*a* of the cap 80, so that the lock of the second locking means 30 is not released.

Therefore, the operation of the operation lever 7 cannot be performed, and the spinning top toy 50 is not erroneously launched.

Only when the cap is mounted to any one of the spinning top toy holders, the operation unit can be operated. Further, even when the cap is mounted to any one of the spinning top toy holders, and when the cap is mounted in the lower side, the operation unit cannot be operated. This means that the spinning top toy can be launched only when the spinning top toy is mounted in the lower side. As a result, an erroneous shooting of the spinning top toy can be prevented.

Modification Example of the Present Invention

The embodiments of the present invention were described above, but the present invention is not limited to the aforementioned embodiments, and needless to say, various modifications may be made within the scope that does not depart from the essential point of the present invention.

For example, in the aforementioned embodiment, the coil spring 11 is used as the power source of the rotation driving mechanism 10, but it may be applied in a case of using a motor. Further, it may be applied in which normally, the spinning top toy holder is rotated through the rotation shaft by pulling a string (operation unit) which is wound up to the rotation body by the coil spring. In addition, it may be applied in which the spinning top toy holder is rotated by operating the rotation driving mechanism, which includes a pinion and a rotation shaft, by a rack belt (operation unit). Further, the locking component may be a component which linearly moves.

The above and/or other aspects, features and/or advantages of various embodiments will be further appreciated in view of the description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

What is claimed is:

1. A spinning top launching device for spinning a spinning top on a floor, comprising:

a rotation driving mechanism including an operation unit and a rotation shaft, the operation unit including an operation component;

first and second holders being configured on first and second ends of the rotation shaft respectively, the top being arranged to be attached to one of the first and second holders;

a cap to cover one of the first and second holders;

a first locking mechanism being configured to block rotating the first and second holders by locking the operation component or by locking the first and second holders when the cap is not mounted on one of the first and second holders, and being configured to unlock rotating the first and second holders by being engaged with the cap when the cap is mounted on one of the first and second holders; and a second locking mechanism being configured to block rotating the first and second holders by locking the operation component or by locking the first and second holders when the cap is mounted on one of the first and second holders and when the cap is arranged to face downwardly to a lower side opposite to the upper side, the second locking mechanism includes a seesaw body being configured to rotate on a plane parallel to the rotation shaft, the seesaw body includes an arm having a first end and a second end opposite to the first end, and a fulcrum between the first and second end, the seesaw body is configured to set a rotational moment around a shaft of the arm with the first end larger than the second end opposite to the first end so as to be rotated by a gravity, and is configured to perform locking and unlocking by the second end, the arm is configured to lock the operation component at the second end or lock the first and second holders at the second end by restricting a rotation of the seesaw body, and unlock the operation component or unlock the first and second holders by releasing the rotation restriction of the seesaw body.

2. The spinning top launching device according to claim 1, wherein the first locking mechanism includes a lever which is configured to be rotated in a plane orthogonal to the rotation shaft, and is configured to lock and unlock the operation component or the first and second holders by the lever, the first locking mechanism includes a spring, the lever is urged by the spring, and the lever is configured to be rotated against an urging force of the spring to unlock.

3. The spinning top launching device according to claim 1, wherein the operation unit is locked by the first locking mechanism and the second locking mechanism.

4. The spinning top launching device according to claim 3, wherein the operation unit includes an operation handle which is configured to be rotated in a plane orthogonal to the rotation shaft.

5. The spinning top launching device according to claim 1, further comprising a coil spring as a power source to rotate the top toy, wherein the coil spring is wound up by rotating the first and second holders, and the coil spring is released by a user operating the operation unit.

6. A spinning top launching device for spinning a spinning top on a floor, comprising:

a rotation driving mechanism including an operation unit and a rotation shaft, the operation unit including an operation component;

first and second holders being configured on first and second ends of the rotation shaft respectively, the top being arranged to be attached to one of the first and second holders;

a cap to cover one of the first and second holders;

a first locking mechanism being configured to block rotating the first and second holders by locking the operation component or by locking the first and second holders when the cap is not mounted on one of the first and second holders, and being configured to unlock rotating the first and second holders by being engaged with the cap when the cap is mounted on one of the first and second holders;

a coil spring as a power source to rotate the top toy, the coil spring being formed in spiral;

a second locking mechanism being configured to block rotating the first and second holders by locking the operation component or by locking the first and second holders when the cap is mounted on one of the first and second holders and when the cap is arranged to face downwardly to a lower side opposite to the upper side, the second locking mechanism including a seesaw body being configured to rotate on a plane parallel to the rotation shaft, the seesaw body including an arm having a first end and a second end opposite to the first end, the seesaw body including a fulcrum between the first and second end, the seesaw body being configured to set a rotational moment around a shaft of the arm with the first end larger than the second end opposite to the first end so as to be rotated by a gravity, and being configured to perform locking and unlocking by the second end, the arm being configured to lock the operation component at the second end or lock the first and second holders at the second end by restricting a rotation of the seesaw body, and unlock the operation component or unlock the first and second holders by releasing the rotation restriction of the seesaw body the coil spring being configured to be wound up by rotating the first and second holders, the coil spring is released by a user operating the operation unit.

* * * * *